United States Patent [19]

Culling

[11] Patent Number: 4,795,610

[45] Date of Patent: Jan. 3, 1989

[54] CORROSION RESISTANT ALLOY

[75] Inventor: John H. Culling, St. Louis, Mo.

[73] Assignee: Carondelet Foundry Company, St. Louis, Mo.

[21] Appl. No.: 41,411

[22] Filed: Apr. 23, 1987

[51] Int. Cl.[4] ..... C22C 30/02

[52] U.S. Cl. ..... 420/582; 420/584; 420/587

[58] Field of Search ..... 420/582, 587, 584

[56] References Cited

U.S. PATENT DOCUMENTS

| | | | |
|---|---|---|---|
| Re. 27,226 | 11/1971 | Moskowitz et al. | 420/582 |
| 3,811,875 | 5/1974 | Goda, Jr. et al. | 420/582 |
| 4,141,762 | 2/1979 | Yamaguchi et al. | 420/584 |
| 4,329,173 | 5/1982 | Culling | 420/45 |

FOREIGN PATENT DOCUMENTS

| | | | |
|---|---|---|---|
| 0210157 | 12/1983 | Japan | 420/584 |

*Primary Examiner*—L. Dewayne Rutledge
*Assistant Examiner*—David Schumaker
*Attorney, Agent, or Firm*—Senniger, Powers, Leavitt and Roedel

[57] ABSTRACT

An air-meltable, castable, weldable, non-magnetic alloy resistant to corrosion in chloride-containing fluids as well as in many other corrosive streams. The alloy consists essentially of between about 20.7% and about 27.2% by weight nickel, between about 19.3% and about 22.7% by weight chromium, between about 0.94% and about 2% by weight molybdenum, between about 2.6% and about 3.2% by weight copper, between about 3.2% and about 4.2% by weight manganese, between about 0.27% and about 2.02% niobium, between about 0.10% and about 0.25% by weight nitrogen, up to about 0.08% by weight carbon, up to about 0.9% by weight silicon, up to about 0.7% by weight titanium, up to about 1% by weight vanadium, up to about 0.6% by weight of a rare earth component selected from the group consisting of cerium, lanthanum, and misch metal, up to about 1% by weight cobalt, and the balance essentially iron. The sum of the nickel and cobalt contents should be between about 21.7% and about 27.2% by weight.

7 Claims, No Drawings

CORROSION RESISTANT ALLOY

BACKGROUND OF THE INVENTION

The selection of a metallic material for each application in the field of corrosion, as in any other field, dictates some compromise in material characteristics, such as cost, availability, fabricability, strength, ductility, hardness, magnetic properties, and degree of corrosion resistance provided by each material. No single material is best in all properties. A need has always remained for new metallic alloys that provide a better mix of properties for each corrosion situation at lower relative cost.

In some applications, it is also desirable that such alloys be substantially non-magnetic. One such application is for naval mine sweepers which most avoid destruction by magnetic mines. Non-magnetic alloys are also advantageous materials of construction for submarines since they allow the vessel to elude the magnetic anomaly detector systems that are employed to locate submerged submarines. These systems sense changes in the earth's magnetic field caused by metallic masses as large as steel submarines.

For various physical and metallurgical reasons there are many chemical elements that are not compatible in iron-base or nickel-base alloy systems. There are other elements, such as platinum and palladium that are quite compatible but too scarce and expensive to have been employed commercially in such alloys. Hence, most if not all of the practical commercial stainless steels, nickel-base corrosion-resistant alloys and related alloys are comprised of elements chosen from the same group. Nonetheless, significant advances have come from new combinations and proportions of these same elements. In addition to nickel, the most widely employed elements from this group are chromium, molybdenum, manganese, silicon and carbon. Also, of considerably wide usage are columbium (niobium), copper, titanium, and, almost by coincidence, cobalt and tantalum.

Other elements less widely selected for these corrosion-resistant alloys are tungsten, nitrogen, boron and rare earth elements, i.e., cerium, lanthanum, etc. Various combinations of these elements are used to formulate all iron-base or nickel-base corrosion resistant alloys of any significant employment. Hence, there has always remained in this field a continuing need for new combinations of these elements that will give better resistance in certain corrosive media or provide better combinations of such properties as fabricability, strength, toughness, or lower strategic element content and hence, lower cost.

For handling seawater and chloride-containing fluid streams, as in all other materials selections, a need has persisted for alloys of improved cost-effectiveness. For example, the element tantalum or the alloy of titanium containing 20% molybdenum and 0.2% palladium will effectively show almost no corrosive attack in boiling solutions of extremely aggressive oxidizing or reducing solutions, whether or not they contain chlorides. However, there isn't enough tantalum in the entire earth's crust to make it available for ordinary structural use. It is a semiprecious and extremely rare element almost like platinum. While titanium is far more plentiful, alloying it with 20 to 40% molybdenum and even a small amount of palladium results in an alloy of very high cost and unsuitability to production and fabrication by ordinary methods.

Also, there have been a few nickel-base alloys of very high total strategic element content that resist salt water and various corrosive chemical streams. Such alloys have often failed in media that do not readily attack titanium or tantalum alloys. Reducing strategic metal content has generally resulted in narrower performance capabilites.

Much of the alloy research in this field as in many other corrosion applications is directed toward materials that effectively meet narrower or more restricted service situations with both relatively low strategic element content and non-stringent production and fabrication requirements, and hence finished costs that are very much lower than those incurred with high strategic metal content alloys.

It is recognized that alloys intended for salt water service depend largely upon some combination of molybdenum and chromium contents. If they are to be castable by the usual lower cost production methods they will also contain some nickel and be of the austenitic, or face-centered-cubic crystalline structure. Variations in some other elements have been found to increase or decrease seawater resistance to some extent. Prior art alloys of this type have tended to contain about 20% Cr, 6% Mo and various Ni contents. I am applying for a U.S. patent on an improved alloy of about 18% Cr, 7.5% Mo plus nickel (Ser. No. 947,427 filed 12/29/86) and another alloy of about 24% Cr, 4.75% Mo plus nickel (Ser. No. 947,095 filed 12/29/86). In addition, my U.S. Pat. No. 3,947,266 covers alloys of about 26 to 30% Cr, 3 to 4% Mo plus nickel, that resist sea water and many other corrosive streams. The same is true for alloys of my U.S. Pat. No, 3,759,704 which contain 33 to 42% Cr, 3 to 8% Mo plus nickel.

Also, an alloy commercially available under the tradename of SANICRO 28, containing 27% Cr, 3.5% Mo plus Ni, was developed originally for production of phosphoric acid. It has now been found to be quite suitable for sea water service.

It is desirable to achieve adequate resistance with the minimum of Cr, Mo and, hence Ni. Since Mo is a much scarcer element than Cr, each weight percent reduction in Mo is several times more cost-effective than the equivalent weight percent reduction in Cr.

Fontana U.S. Pat. No. 2,214,128 describes an alloy containing from 1 to 4% manganese and 2–6% molybdenum. Fontana states that manganese, when used in the proportions set forth, adds the quality of ease of fabrication. Fontana actually presents only one example of his invention, which contains 3.40% Mo, 2.08% Mn, 1.98% Cu, 0.98% Si and 0.09% C.

Thyssen Rohrenwerkee Akiengesellschaft, British patent. No. 1,062,658, discloses the use of 3 to 12% manganese and 0.17 to 0.24% nitrogen in modified stainless steels containing 0 to 4% molybdenum and 0 to 0.15% columbium with no copper. Neither copper nor molybdenum are essential ingredients of that disclosure. Also, in the three examples disclosed in British patent No. 1,062,658, nickel contents are 10.1% or lower, and manganese contents are 6.7% or higher. It is further stated British patent No. in 1,062,658 that articles intended for exposure to seawater and/or to a sea atmosphere should contain 0 to 3% Mo, 0 to 0.15% Cb, 3 to 12% Mn, 15 to 22% Cr and 9 to 16% Ni. This reference further states that under conditions of local corrosion the preferred composition is up to 12% Mn, 1 to 4% Mo, 9 to 25% Ni, 17 to 25% Cr, 0.17 to 0.4% N, and up to 0.15% Cb.

My prior inventions, as described in Culling U.S. Pat. No. 4,135,919 and Culling U.S. Pat. No., 4,329,173, were disclosed for use in handling various concentrations of sulfuric acid.

SUMMARY OF THE INVENTION

Among the several objects of the present invention, therefore, may be noted the provision of novel alloys wich are resistant to seawater and various chemical solutions containing chlorides, as well as other chemical solutions of both oxidizing and reducing nature; the provision of such alloys which can be cast or wrought; the provision of such alloys which have low hardness and high ductility so that they may be readily rolled, forged, welded, machined and cold-formed; the provision of such alloys which may be economically formulated with relatively low proportion of strategic metals such as nickel and molybdenum; the provision of such alloys whose strategic metal content is sufficiently low so that they may be formulated from such relatively low-cost raw materials as scraps, ferro alloys or other commercial melting alloys; the provision of such alloys which are substantially nonmagnetic, i.e. for military and naval applications such as minesweepers and submarines; the provision of such alloys that do not require heat treatment after welding to avoid inter-granular attack; and the provision of such alloys which resist pitting attack, crevice corrosion and stress corrosion cracking failures.

Briefly, therefore, the present invention is directed to an air-meltable, castable, workable, nonmagnetic alloy resistant to various extremely corrosive substances, including corrosive materials containing high levels of chlorides. The alloy consists essentially of between about 20.7% and about 27.2% by weight nickel, between about 19.3% and about 22.7% by weight chromium, between about 0.94% and about 2% by weight molybdenum, between about 2.6% and about and 3.2% by weight copper, between about 3.2% and about 4.2% by weight manganese, between about 0.27% and about 2.02% by weight niobium, between about 0.10 and about 0.25% by weight nitrogen, up to about 0.08% by weight carbon, up to about 0.9% by weight silicon, up to about 0.7% by weight titanium, up to about 1% by weight vanadium, up to about 0.6% by weight of a rare earth component selected from the group consisting of cerium, lanthanum, and misch metal, up to about 1% by weight cobalt, up to about 1% tantalum, and the balance essentially iron. The sum of the nickel content and the cobalt content should be between about 21.7% and about 27.2% by weight.

The invention is further directed to an air-meltable, castable, weldable, non-magnetic alloy resistant to corrosion in chloride containing fluids, consisting essentially of between about 23% and about 24% by weight nickel, approximately 20.5% by weight chromium, approximately 1.8% by weight molybdenum, approximately 3% by weight copper, approximately 3.5% by weight manganese, approximately 0.6% by weight niobium, approximately 0.15% by weight nitrogen, approximately 0.35% by weight silicon, approximately 0.03% by weight carbon, up to about 1% by weight cobalt.

Other objects and features will be in part apparent and in part pointed out hereinafter.

DESCRIPTION OF THE PREFERRED EMBODIMENT

In accordance with the present invention, alloys are provided whose proportions of strategic metals are generally lower than prior art alloys with effective corrosion resistance to sea water. However, despite the low strategic metal content of the alloys of the invention, these alloys are highly resistant to corrosion by a wide variety of hot or cold oxidizing or reducing substances with and without chloride contamination. nation.

The alloys of the invention also exhibit very low magnetic permeabilities and are thus uniquely suited for such military or naval applications where nonmagnetic character is extremely important.

The alloys of this inventions are also essentially single-phase solid solutions having an austenitic (face-centered cubic) crystallographic structures. These alloys not only possess low hardness and high ductility as-cast but also remain unaffected by various heat treatments or heating cycles, including those encountered during welding.

The essential components of the alloys of the invention are:

| | | |
|---|---|---|
| Nickel | 20.7–27.2% | by weight |
| Chromium | 19.3–22.7% | |
| Molybdenum | 0.94–2.0% | |
| Copper | 2.6–3.6% | |
| Manganese | 3.2–4.2% | |
| Columbium (Niobium) | 0.27–2.02% | |
| Nitrogen | 0.10–0.25% | |
| Iron | Balance | |
| Nickel + Cobalt ≧ 21.7% | | |

Optionally the alloys of the invention may further contain:

| | |
|---|---|
| Tungsten | Up to 0.7% |
| Titanium | Up to 0.7% |
| Vanadium | Up to 1% |
| Cobalt | Up to 1% |
| Tantalum | Up to 1% |
| Silicon | Up to 0.9% |
| Boron | Up to 0.01% |
| Cerium, Lanthanum or misch metal | Up to 0.6% |

For enhanced resistance to the widest range of corrosive conditions the components of alloys of this invention are preferably restricted to the following range of proportions:

| | |
|---|---|
| Nickel | 21–26% |
| Chromium | 19–22% |
| Molybdenum | 1.1–1.9% |
| Copper | 2.8–3.2% |
| Manganese | 3–4% |
| Columbium | 0.5–1.5% |
| Nitrogen | 0.10–0.25% |
| Silicon | 0.5% Maximum |
| Carbon | 0.00–0.08% |
| Nickel + Cobalt | ≧22% |

In an especially preferred embodiment of the invention, the components of the alloys are even further restricted to the following ranges of proportions:

| | |
|---|---|
| Nickel | 23–25% |
| Chromium | 19.5–21% |
| Molybdenum | 1.3–1.9% |
| Copper | 2.8–3.2% |
| Manganese | 3.2–3.8% |
| Columbium | 0.5–0.8% |
| Nitrogen | 0.15–0.20% |
| Silicon | 0.10–0.45% |
| Carbon | 0.01–0.05% |
| Nickel + Cobalt ≧ 23% | |

A particularly advantageous alloy having optimum properties in various services has the following composition:

| | |
|---|---|
| Nickel | 24% |
| Chromium | 20.5% |
| Molybdenum | 1.8% |
| Copper | 3% |
| Manganese | 3.5% |
| Columbium | 0.6% |
| Nitrogen | 0.15% |
| Silicon | 0.35% |
| Carbon | 0.03% |
| Iron | balance |

In this instance also, cobalt may be substituted for nickel in a proportion of up to about 1% by weight.

While chromium, molybdenum and copper are well-known elements for providing resistance to a wide variety of corrosive agents, the roles of manganese and nitrogen are less well understood, especially in alloys intended to resist sea water or chloride contamination. Manganese and nitrogen are effectively utilized in alloys of this invention to help reduce the necessary concentration of the required chromium-molybdenum combination for service in chloride containing environments. They are further very effective in reducing the nickel content requirements for maintaining the austenitic structure.

While manganese and chromium both increase solid solubility for the gas nitrogen, their effects on low temperature crystal structure are complex. Chromium additions to iron-nickel alloys up to about 18% Cr reduce the amount of nickel required to maintain the face-centered cubic structure at or near room temperature. Increasing chromium level beyond about 18% tends to raise the nickel requirement.

In a similar fashion, manganese additions to iron, to iron-nickel alloys or to iron-nickel-chromium alloys of less than about 23% Cr, in proportions up to about 4% manganese, begin to reduce the required nickel content even further. Further increases of Mn above about 12% Mn in 18% Cr alloys, or above about 7% Mn in 20% Cr alloys, or above about 4.2% Mn in 23% Cr alloys begin to once more increase nickel requirements.

Hence, the proportions of Ni, Mn and nitrogen are optimally balanced in alloys of this invention against the ferritizing elements, Cr, Mo, Cb (Nb) and possibly small amounts of W, Ti, V, Ta, and Si, to maintain the desired crystal structure in a stable state. Thus, the limits of the ferritizing elements are established on a crystallographic basis, even though all of them are beneficial in various corrosive conditions provided they do not cumulatively exceed the effects of the austenitizing elements Ni, Mn, and N.

The minimum effective chromium vs. molybdenum contents for all of the sea water-resistant alloys above form a continuous relationship. My copending application Ser. Nos. 947,427 and 947,095 specify a continous relationship for minimum molybdenum content as a function of chromium content. If they conformed to this relationship, the alloys of this invention which contain from about 19.3% Cr to about 27.2% Cr and would necessarily contain about 4.5% Mo to about 6.53% Mo. In actual fact, they contain only from 0.94% to about 2.00% Mo, with the preferred embodiment containing about 1.5% Mo, instead of the 5.7% Mo that would have been expected from prior art seawater-resistant alloys. While the alloys of the present invention are not completely resistant to seawater levels of chlorides, the same is true for many alloys employed in seawater service.

Nonetheless, the alloys of this invention provide very useful resistance to sea water level chlorides and excellent resistance to chloride-contaminated chemical streams and many other corrosive substances, including various sulfuric acid concentrations. In addition, they have excellent mechanical properties, fabricability, and relatively low cost, and are nonmagnetic.

Copper has been employed in many alloys intended especially to resist mineral acids, but several prior art alloys have restricted it to about 1.7% maximum content in alloys intended for sea water resistance. In alloys of this invention the optimum content of copper is effectively increased to a range of 2.6 to 3.6%, without damaging the salt water resistance but still maintaining excellent resistance to mineral acids.

Thus, in contrast to the disclosure of Fontana U.S. Pat. No. 2,214,128, alloys of the present invention always contain less than 2% Mo, less than 0.09% C and more than 2% Cu. Nitrogen, an essential element of the present invention, is not disclosed by Fontana. In view of the fact that Fontana only presents tests of one low Mn alloy in three concentrations of sulfuric acid at moderate concentrations of sulfuric acid and moderate temperature of 50° C., his disclosure does not reflect an understanding of the beneficial effects upon chloride resistance conferred by the nitrogen and manganese levels of the present invention. Nor does he teach the use or importance of columbium in such alloys.

While carbon is also a very powerful austenite stabilizer it is notoriously damaging under most corrosive conditions, particularly after welding and certain heat treatments. In the alloys of this invention the permissible carbon levels are readily neutralized by the presence of columbium. Titanium and tantalum have also been employed as carbide stabilizers and some proportions of these may be tolerated without detriment, for example, as derived from alloy formulation sources such as remelt scrap or other commercial melting stocks and ferro alloys.

Tungsten is also often encountered in recycling and reclaiming of a number of heat-resistant and corrosion-resistant alloys, and may be tolerated to some extent in alloys of the present invention. Also, cobalt occurs naturally in many nickel ores and may be substituted for nickel without detriment to corrosion resistance of these alloys when it is encountered either from the nickel sources or from remelt scraps and parts that contain intentionally added cobalt.

Thus, alloys of this invention are quite tolerant of moderate contents of Ti, Ta, W and Co and hence, suitable for wide use of reclaimed and recycled alloy sources. Another element sometimes encountered is vanadium. I have discovered that vanadium enhances resistance to chlorines and refines or reduced grain size in castings and ingots of these alloys. Hence, vanadium may be tolerated in alloys of this invention up to about 1%, even though it is a powerful ferritizing element.

Silicon is similar to vanadium in aiding resistance to some corrosion conditions, but its content in alloys of the present invention is restricted for purposes of maintaining workability and weldability.

Small additions of boron and/or rare earth components may be optionally included in alloys of this invention to further enhance workability.

The following examples illustrate the invention.

EXAMPLE 1

One hundred pound heats of several different alloys were prepared in accordance with the invention. Each of the heats was air-melted in a 100-pound high frequency induction furnace. The composition of these alloys is set forth in Table I, with the balance in each instance being esssentially iron.

Standard physical test blocks and corrosion test bars were prepared from each heat. Using the as-cast non-heat-treated physical test blocks, the mechanical properties of each of these alloys were then measured. The results of these masurements are set forth in Table II.

TABLE I

| ALLOY NUMBER | Alloy Composition - % By Weight Alloying Elements | | | | | | | | | |
|---|---|---|---|---|---|---|---|---|---|---|
| | Ni | Cr | Mo | Cu | Mn | Cb | Si | C | N | OTHERS |
| 1240 | 25.79 | 22.67 | 1.99 | 2.67 | 3.67 | 2.02 | .28 | 0.3 | .25 | .68W .59V |
| 1280 | 21.72 | 19.66 | 1.64 | 2.98 | 3.20 | .69 | .19 | .05 | .15 | |
| 1291 | 23.11 | 19.63 | 1.26 | 3.08 | 3.56 | .27 | .28 | .04 | .16 | |
| 1293 | 24.06 | 19.73 | 1.83 | 3.12 | 3.70 | .62 | .29 | .03 | .18 | |
| 1298 | 24.29 | 20.41 | 1.09 | 3.04 | 3.70 | .56 | .15 | .03 | .20 | |
| 1299 | 24.95 | 20.51 | 1.09 | 3.08 | 3.66 | 1.36 | .17 | .08 | .11 | |
| 1300 | 23.88 | 20.57 | 1.36 | 3.17 | 3.59 | .85 | .29 | .03 | .14 | |
| 1301 | 23.75 | 20.26 | 1.30 | 3.22 | 3.54 | 1.42 | .21 | .08 | .17 | |
| 1302 | 23.69 | 20.30 | 1.97 | 3.09 | 3.42 | .62 | .34 | .04 | .10 | |
| 1303 | 24.01 | 20.24 | 1.86 | 2.95 | 3.51 | 1.36 | .19 | .07 | .22 | |
| 1309 | 23.93 | 20.97 | 1.71 | 3.06 | 3.33 | .32 | .22 | .03 | .19 | |
| 1380 | 21.99 | 19.41 | .94 | 3.54 | 4.13 | .48 | .46 | .04 | .17 | |
| 1382 | 24.97 | 21.25 | 1.77 | 3.30 | 3.77 | .65 | .47 | .01 | .24 | |
| 1383 | 24.35 | 21.84 | 1.79 | 3.09 | 3.92 | 1.02 | .48 | .01 | .24 | |
| 1385 | 27.21 | 21.64 | 1.08 | 3.19 | 3.73 | 1.17 | .20 | .02 | .23 | |
| 1404 | 23.25 | 20.87 | 1.47 | 2.75 | 3.74 | .57 | .42 | .01 | .16 | |

TABLE II

PHYSICAL PROPERTIES OF ALLOYS AS CAST

| ALLOY NUMBER | TENSILE STRENGTH P.S.I. | YIELD STRENGTH P.S.I. | TENSILE ELONGATION % | BRINELL HARDNESS NUMBER |
|---|---|---|---|---|
| 1240 | 65,000 | 35,000 | 46.0 | 149 |
| 1280 | 64,690 | 25,580 | 43.0 | 127 |
| 1291 | 72,650 | 26,860 | 52.5 | 155 |
| 1293 | 70,860 | 24,250 | 47.5 | 146 |
| 1298 | 67,600 | 26,300 | 42.0 | 124 |
| 1299 | 70,480 | 26,900 | 39.0 | 142 |
| 1300 | 70,150 | 26,500 | 47.5 | 144 |
| 1301 | 71,000 | 22,300 | 41.5 | 138 |
| 1302 | 71,160 | 29,450 | 47.0 | 137 |
| 1303 | 72,500 | 29,300 | 40.0 | 143 |
| 1309 | 73,890 | 30,550 | 47.5 | 155 |
| 1380 | 65,670 | 29,960 | 42.5 | 126 |
| 1382 | 65,880 | 26,050 | 47.5 | 121 |
| 1383 | 62,530 | 27,500 | 39.5 | 121 |
| 1385 | 64,450 | 28,920 | 38.0 | 118 |
| 1404 | 69,340 | 27,190 | 48.0 | 118 |

Without heat treatment, the corrosion test bars were machined into $1\frac{1}{2}$ inch diameter by $\frac{1}{4}$ inch thick discs, each having a $\frac{1}{8}$ inch diameter hole in the center. These discs were carefully ground and then polished to a 600-grit finish.

These discs were used in comparative corrosion tests, described hereinafter, comparing the performance of the alloys of this invention with a number of alloys which either conform to the prior art or which are similar to the alloys of the invention but do not satisfy certain of the critical composition limitations of the alloys of the invention. The compositions of the comparative alloys used in the tests are set forth in Table III.

TABLE III

COMPARATIVE ALLOY COMPOSITIONS PERCENT BY WEIGHT ALLOYING ELEMENTS

| ALLOY NUMBER | Ni | Cr | Mo | Cu | Mn | Cb | Si | C | N |
|---|---|---|---|---|---|---|---|---|---|
| 1254 | 17.47 | 17.57 | .92 | 3.69 | 4.16 | .57 | .44 | .04 | .04 |
| 1263 | 21.58 | 17.45 | .52 | 3.17 | .56 | .56 | .31 | .07 | .03 |
| 1272 | 19.85 | 18.21 | .94 | 3.12 | 3.23 | .54 | .15 | .03 | .03 |
| 1242 | 29.13 | 26.98 | .84 | 3.67 | 4.15 | .19 | .30 | .03 | .05 |
| 1247 | 29.12 | 27.56 | .66 | 3.82 | 4.57 | .71 | .40 | .03 | .05 |
| 1251 | 18.88 | 16.60 | 2.01 | 4.58 | .84 | .29 | .23 | .03 | .22 |
| 1356 | 21.40 | 22.72 | .22 | 3.42 | 3.90 | .47 | .28 | .02 | .04 |
| 1373 | 19.50 | 16.68 | .78 | 3.32 | 3.59 | .39 | .11 | .02 | .02 |
| 1386 | 21.85 | 18.37 | .73 | 3.01 | 3.73 | .53 | .16 | .01 | .03 |
| 1297 | 24.91 | 19.88 | .58 | 3.11 | 3.66 | 1.50 | .18 | .04 | .04 |
| 1271 | 21.07 | 18.32 | 1.35 | 3.11 | 3.31 | .68 | .09 | .05 | .03 |
| 1384 | 22.15 | 21.67 | 4.03 | 3.05 | 3.94 | .63 | .55 | .01 | .06 |
| 1379 | 21.50 | 18.95 | .90 | 3.59 | 4.20 | .61 | .11 | .02 | .05 |
| 1264 | 19.91 | 19.01 | 1.86 | 3.00 | 3.64 | .62 | .46 | .03 | .04 |
| 1232 | 26.52 | 22.37 | 1.03 | 2.50 | 3.83 | .06 | .36 | .06 | .06 |
| 1225 | 31.19 | 26.33 | 3.02 | 3.55 | 3.30 | 2.38 | .43 | .06 | .05 |
| 1222 | 30.67 | 23.63 | 3.33 | 5.18 | 2.71 | .07 | .78 | .09 | .04 |
| 1262 | 18.85 | 17.41 | .53 | 3.24 | 3.97 | .57 | .55 | .05 | .02 |
| 1265 | 18.74 | 17.25 | 1.78 | 3.16 | 3.29 | .53 | .23 | .06 | .03 |
| 1266 | 21.24 | 18.76 | 1.93 | 2.82 | 3.30 | .60 | .44 | .04 | .02 |
| 1269 | 21.15 | 17.61 | 1.82 | 2.51 | 4.07 | .64 | .57 | .07 | .02 |
| 1366 | 10.33 | 18.08 | 1.55 | — | 6.13 | .14 | .46 | .01 | .19 |
| 1221 | 36.72 | 28.84 | 4.10 | 3.86 | 3.55 | .06 | .33 | .04 | .06 |
| 1381 | 22.09 | 19.05 | .83 | 3.58 | 4.29 | .58 | .29 | .03 | .03 |
| 1217 | 28.59 | 27.02 | 3.04 | 3.64 | 3.01 | .49 | .29 | .04 | .03 |

EXAMPLE 2

Using the disc samples of Example 1, samples of all heats were immersed in salt water to a depth of about $1-\frac{3}{4}$ inches of solution held in plastic containers with tight-fitting lids. The salt water was prepared by dissolving 4 ounces of ordinary uniodized table salt per gallon of distilled water. Twenty-five different samples were placed flat on the bottom of each container in such a manner that no samples touched each other. The lids were employed to avoid evaporation and were removed once a day long enough for sample inspection. The solution was siphoned off and replaced every seven days. The samples were so immersed for a total period of sixty days at ordinary room temperatures. At the end of the sixty day exposure, none of the samples of the invention showed any pitting when examined under a 10-power magnifying glass. However, the test discs from alloys not of the invention were observed to first show some surface staining and pitting after the number of days reported in Table IV.

TABLE IV

| ALLOY NUMBER | NUMBER OF DAYS REQUIRED FOR FIRST STAINS TO APPEAR | NUMBER OF DAYS REQUIRED FOR PITTING TO BE OBSERVED AT 10X MAG. |
|---|---|---|
| 1217 | 1 | 6 |
| 1221 | 18 | 58 |
| 1222 | 15 | 46 |
| 1225 | 38 | None observed |
| 1232 | 2 | 4 |
| 1242 | 1 | 4 |
| 1247 | 1 | 6 |
| 1251 | 48 | None observed |
| 1254 | 7 | 19 |
| 1262 | 1 | 4 |
| 1263 | 2 | 6 |
| 1264 | 6 | 15 |
| 1265 | 3 | 9 |
| 1266 | 1 | 3 |
| 1269 | 3 | 8 |
| 1271 | 4 | 9 |
| 1272 | 2 | 6 |
| 1297 | 3 | 8 |
| 1356 | 1 | 2 |
| 1366 | 8 | 19 |
| 1373 | 1 | 4 |
| 1379 | 1 | 2 |
| 1381 | 2 | 6 |
| 1384 | 34 | None observed |
| 1386 | 3 | 8 |

EXAMPLE 3

Using disc samples of Example 1, corrosion tests were run in 10%, 25%, 40%, 50%, 60% and 97% by weight sulfuric acid solution at 80° C. (176° F.).

In carrying out these tests, each of the discs was cleaned in carbon tetrachloride, followed by a five hour exposure to 10% nitric acid-water solution at 80° C. and then rinsed in water and dried. This procedure was selected to remove any residual machining oil, dirt, or grit from the polishing operations. Each clean, dry disc was weighed to the nearest 10,000 th of a gram and then suspended for five days by a platinum wire in a beaker containing 600 milliliters of test solution thermostatically controlled at 80° C., and each beaker was covered with a watch glass to minimize evaporation. The solutions were replaced once a day by fresh solutions that were preheated to 80° C. just prior to the changes.

After precisely five days total exposure time, the sample discs were removed from the test solution, cleaned with a hard bristle brush and tap water, and dried. The discs were then weighed to the nearest 10,000 th of a gram. The corrosion rate of each disc, in inches per year was then calculated. The results of the tests on alloys of this invention are set forth in Table V, and the results of tests on alloys not of this invention are set forth in Table VI.

TABLE V

CORROSION RATE IN INCHES PER YEAR (I.P.Y.) PENETRATION AT 80° C. FOR VARIOUS SULFURIC ACID-WATER SOLUTIONS

| ALLOY NUMBER | SULFURIC ACID STRENGTH (% BY WEIGHT $H_2SO_4$) | | | | | |
|---|---|---|---|---|---|---|
| | 10% | 25% | 40% | 50% | 60% | 97% |
| 1291 | 0.0019 | 0.0000 | 0.0046 | 0.0086 | 0.0068 | 0.0104 |
| 1298 | 0.0046 | 0.0000 | 0.0000 | 0.0000 | 0.0000 | 0.0042 |
| 1299 | 0.0008 | 0.0000 | 0.0014 | 0.0000 | 0.0068 | 0.0074 |
| 1302 | 0.0008 | 0.0000 | 0.0000 | 0.0051 | 0.0086 | 0.0059 |
| 1309 | 0.0000 | 0.0000 | 0.0000 | 0.0000 | 0.0062 | 0.0002 |
| 1380 | 0.0011 | 0.0022 | 0.0091 | 0.0097 | 0.0078 | 0.0058 |
| 1383 | 0.0064 | 0.0000 | 0.0088 | 0.0072 | 0.0098 | 0.0082 |
| 1385 | 0.0000 | 0.0000 | 0.0093 | 0.0087 | 0.0061 | 0.0074 |
| 1382 | 0.0016 | 0.0000 | 0.0068 | 0.0097 | 0.0086 | 0.0041 |
| 1404 | 0.0000 | 0.0000 | 0.0000 | 0.0000 | 0.0058 | 0.0033 |
| 1301 | 0.0000 | 0.0000 | 0.0000 | 0.0016 | 0.0054 | 0.0027 |
| 1240 | 0.0000 | 0.0000 | 0.0016 | 0.0093 | 0.0089 | 0.0067 |
| 1300 | 0.0000 | 0.0000 | 0.0000 | 0.0016 | 0.0024 | 0.0022 |
| 1303 | 0.0005 | 0.0000 | 0.0008 | 0.0086 | 0.0081 | 0.0019 |
| 1293 | 0.0019 | 0.0030 | 0.0000 | 0.0000 | 0.0000 | 0.0022 |
| 1280 | 0.0000 | 0.0000 | 0.0038 | 0.0084 | 0.0079 | 0.0070 |

TABLE VI

CORROSION RATE IN INCHES PER YEAR (I.P.Y.) PENETRATION AT 80° C. FOR VARIOUS SULFURIC ACID-WATER SOLUTIONS

| ALLOY NUMBER | SULFURIC ACID STRENGTH (% BY WEIGHT $H_2SO_4$) | | | | | |
|---|---|---|---|---|---|---|
| | 10% | 25% | 40% | 50% | 60% | 97% |
| 1221 | 0.0000 | 0.0000 | 0.0103 | 0.0032 | 0.0081 | 0.0035 |
| 1222 | 0.0000 | 0.0000 | 0.0000 | 0.0000 | 0.0000 | 0.0108 |
| 1225 | 0.0011 | 0.0000 | 0.0132 | 0.0108 | 0.0073 | 0.0054 |
| 1232 | 0.0011 | 0.0008 | 0.0005 | 0.0011 | 0.0051 | 0.0257 |
| 1242 | 0.0000 | 0.0000 | 0.0000 | 0.0000 | 0.0000 | 0.0039 |
| 1247 | 0.0000 | 0.0000 | 0.0000 | 0.0000 | 0.0008 | 0.0032 |
| 1251 | 0.0000 | 0.0000 | 0.0053 | 0.0141 | 0.0143 | 0.0183 |
| 1254 | 0.0015 | 0.0000 | 0.0000 | 0.0184 | 0.0119 | 0.0213 |
| 1262 | 0.0000 | 0.0000 | 0.0000 | 0.0000 | 0.0086 | 0.0081 |
| 1263 | 0.0000 | 0.0000 | 0.0000 | 0.0000 | 0.0054 | 0.0054 |
| 1264 | 0.0019 | 0.0000 | 0.0000 | 0.0000 | 0.0049 | 0.0095 |
| 1265 | 0.0014 | 0.0000 | 0.0000 | 0.0000 | 0.0049 | 0.0054 |
| 1266 | 0.0000 | 0.0000 | 0.0000 | 0.0011 | 0.0000 | 0.0041 |
| 1269 | 0.0000 | 0.0008 | 0.0009 | 0.0057 | 0.0076 | 0.0089 |
| 1271 | 0.0000 | 0.0054 | 0.0103 | 0.0073 | 0.0084 | 0.0049 |
| 1272 | 0.0000 | 0.0085 | 0.0127 | 0.0294 | 0.0059 | 0.0049 |
| 1297 | 0.0000 | 0.0000 | 0.0014 | 0.0000 | 0.0027 | 0.0022 |
| 1356 | 0.0000 | 0.0000 | 0.0000 | 0.0000 | 0.0000 | 0.0022 |
| 1366 | 0.0032 | 22+ | 25+ | 25+ | 23+ | 0.0972 |
| 1373 | 0.0027 | 0.0176 | 0.0128 | 0.0095 | 0.0068 | 0.0043 |
| 1379 | 0.0011 | 0.0192 | 0.0173 | 0.0081 | 0.0108 | 0.0057 |
| 1381 | 0.0000 | 0.0144 | 0.0131 | 0.0068 | 0.0094 | 0.0035 |
| 1384 | 0.0000 | 0.0000 | 0.0183 | 0.0094 | 0.0103 | 0.0117 |
| 1386 | 0.0000 | 0.0000 | 0.0084 | 0.0089 | 0.0154 | 0.0101 |
| 1217 | 0.0000 | 0.0000 | 0.0003 | 0.0000 | 0.0014 | 0.0070 |

EXAMPLE 4

Using the method described in Example 3, comparative corrosion tests were conducted for five days total exposure time at 80° C. in 70% nitric acid-water solution, 35% nitric acid-water solution, and 35% nitric acid-water solution to which 4 ounces of sodium chloride per gallon of solution have been added. The results of these test on alloy of the invention are set forth in Table VII. The results of these tests on alloys not of the invention are set forth in Table VIII.

TABLE VII

| CORROSION RATE IN INCHES PER YEAR (I.P.Y.) PENETRATION IN NITRIC ACID-WATER AT 80° C. SOLUTION, WITH AND WITHOUT 2.5% NaCl ADDED | | | |
|---|---|---|---|
| ALLOY NUMBER | 70% BY WEIGHT $HNO_3$ | 35% BY WEIGHT $HNO_3$ | 35% BY WEIGHT $HNO_3$ + 2.5% NaCl |
| 1291 | 0.0009 | 0.0014 | 0.0003 |
| 1298 | 0.0006 | 0.0002 | 0.0009 |
| 1299 | 0.0008 | 0.0019 | 0.0002 |
| 1302 | 0.0013 | 0.0014 | 0.0016 |
| 1309 | 0.0017 | 0.0013 | 0.0006 |
| 1380 | 0.0005 | 0.0002 | 0.0001 |
| 1383 | 0.0018 | 0.0015 | 0.0017 |
| 1385 | 0.0009 | 0.0024 | 0.0002 |
| 1404 | 0.0011 | 0.0014 | 0.0006 |
| 1301 | 0.0013 | 0.0015 | 0.0009 |
| 1240 | 0.0012 | 0.0011 | 0.0018 |
| 1382 | 0.0019 | 0.0017 | 0.0018 |
| 1300 | 0.0010 | 0.0009 | 0.0017 |
| 1303 | 0.0009 | 0.0007 | 0.0012 |
| 1293 | 0.0011 | 0.0010 | 0.0014 |
| 1280 | 0.0013 | 0.0012 | 0.0016 |

TABLE VIII

| CORROSION RATE IN INCHES PER YEAR (I.P.Y.) PENETRATION IN NITRIC ACID-WATER AT 80° C. SOLUTIONS, WITH AND WITHOUT 2.5% NaCl ADDED | | | |
|---|---|---|---|
| ALLOY NUMBER | 70% BY WEIGHT $HNO_3$ | 35% BY WEIGHT $HNO_3$ | 35% BY WEIGHT $HNO_3$ + 2.5% NaCl |
| 1221 | 0.0007 | 0.0014 | 0.0042 |
| 1222 | 0.0006 | 0.0022 | 0.0036 |
| 1225 | 0.0005 | 0.0018 | 0.0023 |
| 1232 | 0.0005 | 0.0008 | 0.0009 |
| 1242 | 0.0008 | 0.0012 | 0.0001 |
| 1247 | 0.0044 | 0.0011 | 0.0004 |
| 1251 | 0.0065 | 0.0015 | 0.0016 |
| 1254 | 0.0038 | 0.0021 | 0.0015 |
| 1262 | 0.0027 | 0.0023 | 0.0020 |
| 1263 | 0.0051 | 0.0048 | 0.0006 |
| 1264 | 0.0012 | 0.0011 | 0.0009 |
| 1265 | 0.0048 | 0.0044 | 0.0009 |
| 1266 | 0.0033 | 0.0008 | 0.0013 |
| 1269 | 0.0045 | 0.0055 | 0.0016 |
| 1271 | 0.0018 | 0.0010 | 0.0011 |
| 1272 | 0.0022 | 0.0015 | 0.0005 |
| 1297 | 0.0009 | 0.0015 | 0.0008 |
| 1356 | 0.0008 | 0.0009 | 0.0013 |
| 1366 | 0.0016 | 0.0022 | 0.0033 |
| 1373 | 0.0062 | 0.0007 | 0.0058 |
| 1379 | 0.0033 | 0.0031 | 0.0055 |
| 1381 | 0.0026 | 0.0016 | 0.0028 |
| 1384 | 0.0004 | 0.0023 | 0.0003 |
| 1386 | 0.0014 | 0.0019 | 0.0009 |
| 1217 | 0.0034 | 0.0041 | 0.0052 |

EXAMPLE 5

Using the method described in Example 3, comparative corrosion tests were conducted for five days total exposure time at 80° C. in 86% phosphoric acid-water solution which also contained 4 ounces of sodium chloride per gallon of solution. The results of these tests on alloys of the invention are set forth in Table IX, and the results of these tests on alloys not of this invention are set forth in Table X.

TABLE IX

| CORROSION RATE IN INCHES PER YEAR (I.P.Y.) PENETRATION AT 80° C. in 86% Phosphoric ACID PLUS 4 OZ/GAL. NaCl ADDED | |
|---|---|
| ALLOY NUMBER | I.P.Y. |
| 1291 | 0.0063 |
| 1298 | 0.0063 |

TABLE IX-continued

| CORROSION RATE IN INCHES PER YEAR (I.P.Y.) PENETRATION AT 80° C. in 86% Phosphoric ACID PLUS 4 OZ/GAL. NaCl ADDED | |
|---|---|
| ALLOY NUMBER | I.P.Y. |
| 1299 | 0.0025 |
| 1302 | 0.0057 |
| 1309 | 0.0044 |
| 1380 | 0.0105 |
| 1383 | 0.0043 |
| 1385 | 0.0096 |
| 1404 | 0.0051 |
| 1301 | 0.0061 |
| 1240 | 0.0036 |
| 1382 | 0.0047 |
| 1300 | 0.0055 |
| 1303 | 0.0056 |
| 1293 | 0.0067 |
| 1280 | 0.0065 |

TABLE X

| Corrosion Rate in Inches Per Year (I.P.Y.) Penetration at 80° C. in 86% Phosphoric Acid Plus 4 oz/gal. NaCl Added. | |
|---|---|
| ALLOY NUMBER | I.P.Y. |
| 1221 | 0.0042 |
| 1222 | 0.0036 |
| 1225 | 0.0019 |
| 1232 | 0.0097 |
| 1242 | 0.0028 |
| 1247 | 0.0107 |
| 1251 | 0.0029 |
| 1254 | 0.0031 |
| 1262 | 0.0115 |
| 1263 | 0.0221 |
| 1264 | 0.0089 |
| 1265 | 0.0053 |
| 1266 | 0.0036 |
| 1269 | 0.0051 |
| 1271 | 0.0168 |
| 1272 | 0.0077 |
| 1297 | 0.0154 |
| 1356 | 0.0197 |
| 1366 | 0.4266 |
| 1373 | 0.0169 |
| 1379 | 0.0050 |
| 1381 | 0.0054 |
| 1384 | 0.0008 |
| 1386 | 0.0033 |

EXAMPLE 6

Using the method described in Example 3, comparative corrosion tests were conducted for a total of five days exposure time at 80° C. in water solution containing 25% sulfuric acid, 10% nitric acid and 4 ounces of sodium chloride per gallon of solution. The results of these tests on alloys of the invention are set forth in Table XI, and the results of these tests on alloys not of this invention are set forth in Table XII.

TABLE XI

| CORROSION RATE IN INCHES PER YEAR (I.P.Y.) PENETRATION AT 80° C. IN WATER SOLUTION CONTAINING 25% $H_2SO_4$, 10% $HNO_3$ & 4 OZ./GAL. NaCl | |
|---|---|
| ALLOY NUMBER | I.P.Y. |
| 1291 | 0.0015 |
| 1298 | 0.0013 |
| 1299 | 0.0005 |
| 1302 | 0.0011 |
| 1309 | 0.0012 |
| 1380 | 0.0009 |
| 1383 | 0.0014 |
| 1385 | 0.0006 |
| 1404 | 0.0008 |
| 1301 | 0.0011 |

TABLE XI-continued

| CORROSION RATE IN INCHES PER YEAR (I.P.Y.) PENETRATION AT 80° C. IN WATER SOLUTION CONTAINING 25% $H_2SO_4$, 10% $HNO_3$ & 4 OZ./GAL. NaCl | |
|---|---|
| ALLOY NUMBER | I.P.Y. |
| 1240 | 0.0010 |
| 1382 | 0.0008 |
| 1300 | 0.0018 |
| 1303 | 0.0014 |
| 1293 | 0.0017 |
| 1280 | 0.0015 |

TABLE XII

| CORROSION RATE IN INCHES PER YEAR (I.P.Y.) PENETRATION AT 80° C. IN WATER SOLUTION CONTAINING 25% $H_2SO_4$, 10% $HNO_3$ & 4 OZ./GAL. NaCl | |
|---|---|
| ALLOY NUMBER | I.P.Y. |
| 1221 | 0.0037 |
| 1222 | 0.0083 |
| 1225 | 0.0031 |
| 1232 | 0.0011 |
| 1242 | 0.0003 |
| 1247 | 0.0016 |
| 1251 | 0.0009 |
| 1254 | 0.0017 |
| 1262 | 0.0017 |
| 1263 | 0.0355 |
| 1264 | 0.0013 |
| 1265 | 0.0016 |
| 1266 | 0.0019 |
| 1269 | 0.0014 |
| 1271 | 0.0001 |
| 1272 | 0.0024 |
| 1297 | 0.0008 |
| 1356 | 0.0006 |
| 1366 | 0.0286 |
| 1373 | 0.0009 |
| 1379 | 0.0042 |
| 1381 | 0.0021 |
| 1384 | 0.0024 |
| 1386 | 0.0014 |
| 1217 | 0.0022 |

In view of the above, it will be seen that the several objects of the invention are achieved and other advantageous results attained.

As various changes could be made in the above products without departing from the scope of the invention, it is intended that all matter contained in the above description shall be interpreted as illustrative and not in a limiting sense.

What is claimed is:

1. An air-meltable, castable, weldable, non-magnetic alloy having a single phase austenitic structure and resistant to corrosion in chloride containing fluids, consisting essentially of between about 20.7% and about 27.2% by weight nickel, between about 19.3% and about 22.7% by weight chromium, between about 0.94% and about 2% by weight molybdenum, between about 2.6% and about 3.2% by weight copper, between about 3.2% and about 4.2% by weight manganese, between about 0.27% and about 2.02% by weight niobium, between about 0.10% and about 0.25% by weight nitrogen, up to about 0.08% by weight carbon, up to about 0.9% by weight silicon, up to about 0.7% by weight titanium, up to about 1% by weight vanadium, up to about 0.6% by weight of a rare earth component selected from the group consisting of cerium, lanthanum, and misch metal, up to about 1% by weight cobalt, and the balance essentially iron, the sum of the nickel content and cobalt content being between about 21.7% and about 27.2% by weight.

2. An alloy is set forth in claim 1 containing between about 35% and about 51% by weight iron.

3. An alloy as set forth in claim 1 containing between about 21% and about 26% by weight nickel, between about 19.3% and about 22% by weight chromium, between about 1.1% and about 1.9% by weight molybdenum, between about 2.8% and about 3.2% by weight copper, between about 3.2% and about 4% by weight manganese, between 0.5% and about 1.5% by weight niobium, between about 0.10% and about 0.25% by weight nitrogen, up to about 0.5% by weight silicon, and up to about 0.08% by weight carbon, the sum of the nickel content and the cobalt content being at least about 22% by weight.

4. An alloy as set forth in claim 3 containing between about 22% and 25% by weight nickel, between about 19.5% and 21% by weight chromium, between about 1.3% and about 1.9% by weight molybdenum, between about 2.8% and 3.2% by weight copper, between about 3.2% and about 3.8% by weight manganese, between 0.5% and 0.8% by weight niobium, between about 0.15% and about 0.20% by weight nitrogen, between about 0.10% and about 0.45% by weight silicon, and between about 0.01% and about 0.05% by weight carbon, the sum of the nickel content and the cobalt content being at least about 23% by weight.

5. An air-meltable, castable, weldable, non-magnetic alloy resistant to corrosion in chloride containing fluids, consisting essentially of between about 23% and about 24% by weight nickel, approximately 20.5% by weight chromium, approximately 1.8% by weight molybdenum, approximately 3% by weight copper, approximately 3.5% by weight manganese, approximately 0.6% by weight niobium, approximately 0.15% by weight nitrogen, approximately 0.35% by weight silicon, approximately 0.03% by weight carbon, up to about 1% by weight cobalt, and the balance essentially iron.

6. An alloy as set forth in claim 5 wherein the sum of the nickel content and the cobalt content is approximately 24% by weight.

7. An alloy as set forth in claim 6 wherein the nickel content is approximately 24% by weight.

* * * * *